United States Patent [19]

Cox

[11] 4,279,135

[45] Jul. 21, 1981

[54] DYEING, WASHING AND/OR MILLING

[75] Inventor: Andrew G. Cox, Bulls, New Zealand

[73] Assignee: Manawatu Textile Dyers Limited, Bulls, New Zealand

[21] Appl. No.: 67,197

[22] Filed: Aug. 16, 1979

[30] Foreign Application Priority Data

Mar. 28, 1979 [NZ] New Zealand ..... 190029

[51] Int. Cl.[3] ..... D06F 17/06; D06B 3/30

[52] U.S. Cl. ..... 68/15; 26/22; 68/53; 68/131; 68/134; 68/184; 366/279; 366/302

[58] Field of Search ..... 68/131, 132, 134, 53, 68/113, 15, 175, 184, 51; 26/19, 22; 366/279, 302, 305, 306, 312, 313, 290, 325

[56] References Cited

FOREIGN PATENT DOCUMENTS

| | | | |
|---|---|---|---|
| 53817 | 10/1937 | Denmark | 68/53 |
| 1295990 | 5/1962 | France | 366/305 |
| 6436 | of 1912 | United Kingdom | 68/113 |
| 1294156 | 10/1972 | United Kingdom | 366/279 |

*Primary Examiner*—Philip R. Coe
*Attorney, Agent, or Firm*—Holman & Stern

[57] ABSTRACT

A dyeing washing and/or milling machine particularly useful for dyeing woollen components including an annular working fluid reservoir and rotating paddle members which pass into and out of the reservoir to circulate the fluid therein. The apparatus may further include a heating system and a fluid pump and duct system, to heat and increase the circulation of fluid within the reservoir.

24 Claims, 5 Drawing Figures

40
42
28
31
30
29
27b
26
25a
27a
25b
25c
31
41
38
39
37
36
55
32
31
35
35
35
33
86
57
60
62
58
59
61

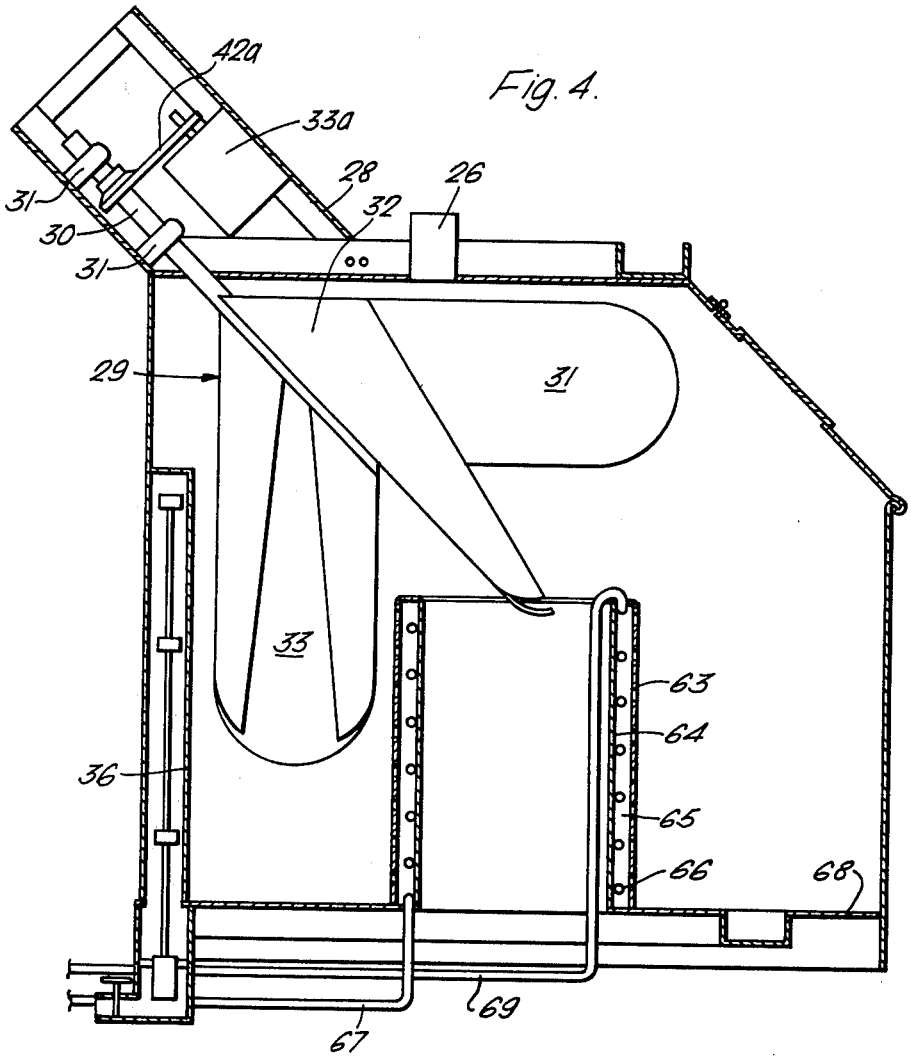
Fig. 4.
Fig. 5.
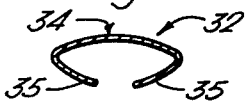

DYEING, WASHING AND/OR MILLING

BRIEF SUMMARY OF THE INVENTION

This invention relates to dyeing, washing and/or milling machines.

Paddle type dyeing/washing/milling machines are well known employing different combinations of paddle and/or working fluid tank configurations.

A problem commonly encountered by all these machines however is uneven circulation of the working fluid at various points in the working fluid tank arising from the position of the paddle and/or the configuration of the tank.

In some configurations of tanks, the circulation created by the paddle reduces to almost zero at points remote from the paddle and thus clothing components being treated in the machine tend to gather at such points and, if not cleared manually, cause a blockage.

Some machines have attempted to overcome this problem by increasing the paddle speed to ensure at least some circulation at all points in the working fluid reservoir. Other machines employ means to reverse the direction of paddle rotation to set up a reverse circulation to untangle any tangled garments.

If however, paddle speed is set too high the paddle can damage clothing components being treated and thus it is desirable, particularly for woollen clothing components, for the paddle speed to be low so as to avoid this damage.

It is an object of the present invention to provide apparatus which will go at least some way in overcoming the aforementioned disadvantages or which will at least provide the public with a useful choice.

Accordingly, the invention consists in a dyeing, washing and/or milling apparatus including a substantially circular working fluid reservoir; an island disposed centrally within said reservoir so as to define an annular channel within said reservoir; and paddle means rotatably mounted above said reservoir in a manner such that upon rotation thereof portions of said paddle means are displaced into and out of said channel.

To those skilled in the art to which this invention relates many changes in construction and widely differing embodiments and applications of the invention will suggest themselves without departing from the scope of the invention as defined in the appended claims. The disclosures and the description herein are purely illustrative and are not intended to be in any sense limiting.

BRIEF DESCRIPTION OF THE SEVERAL VIEWS OF THE DRAWINGS

Various preferred forms of the invention will now be described with reference to the accompanying drawings in which.

FIG. 4 depicts a cross-sectional elevational view of a further alternative form of the invention, and FIG. 5 shows a cross-sectional view through a typical blade of the paddle means according to the invention.

DETAILED DESCRIPTION

Figure 1:
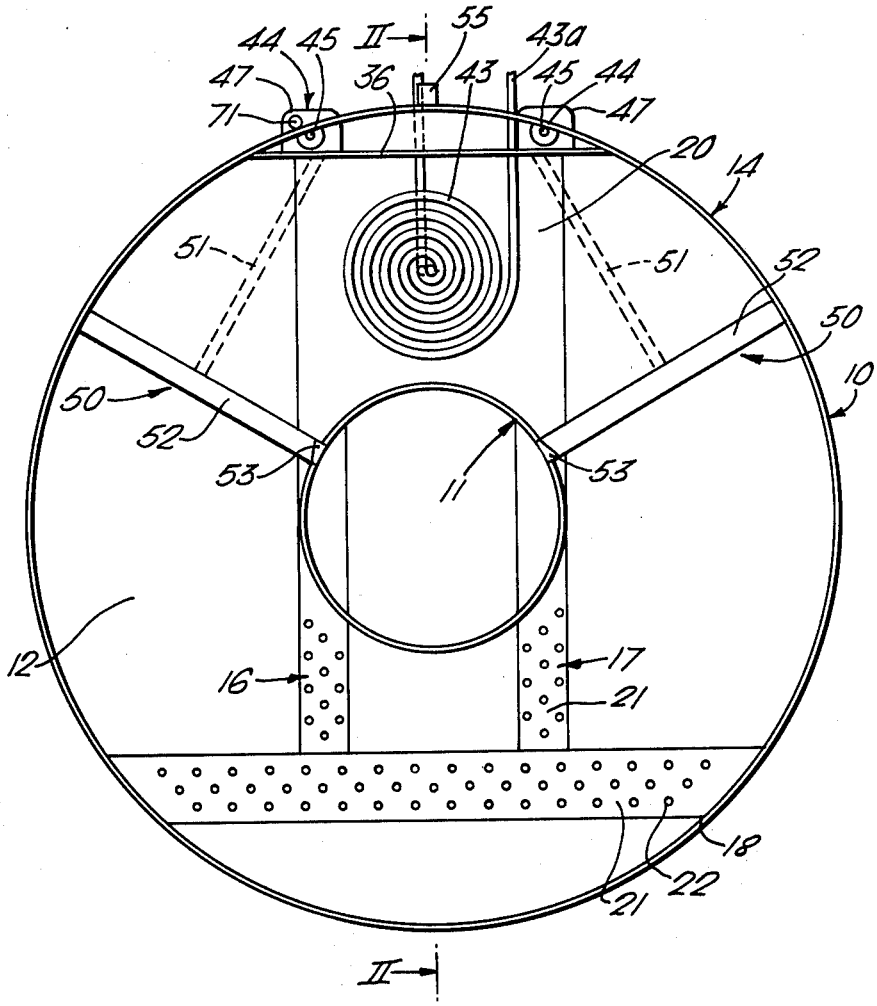
FIG. 1 shows a plan view of one embodiment of apparatus according to the invention with certain parts omitted for clarity.
Figure 2:
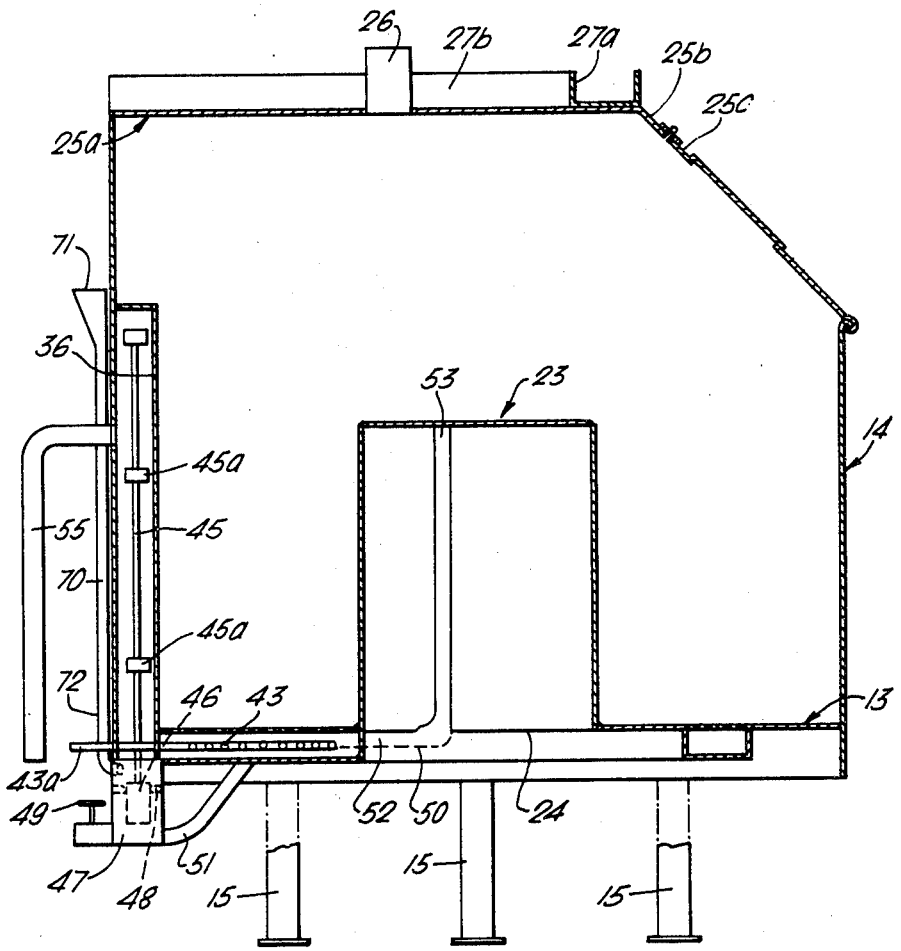
FIG. 2 depicts a view along the line II—II in FIG. 1.

Referring firstly to FIGS. 1 and 2 the invention provides apparatus for dyeing and/or washing and/or milling fabric components preferably woollen garments either in the finished form, in garment lengths which are subsequently attached together to form finished garments, and other components such as, for example socks, hats, gloves, scarves, etc.

As depicted the apparatus comprises a substantially circular working fluid reservoir 10 having a circular island 11 disposed substantially centrally therein so as to define an annular channel 12 between the island 11 and the outer walls of the reservoir 10.

The reservoir 10 preferably includes a substantially flat circular base 13 and a wall section 14 projecting vertically up from the periphery of the base 13. The base 13 is, as shown, supported on three legs 15 equi-spaced about a circumferential line on the base.

The base 13 preferably includes cavities and/or channels set below the plane thereof. As can be seen from FIG. 1 channels 16 and 17 are provided spanning partway across the base parallel to a common diameter of the reservoir and equi-spaced from either side of that diameter. The channels 16 and 17 merge into a further channel 18 running substantially perpendicular thereto. The channels 16 and 17 pass, in a closed manner under the central island and merge into cavity 20 spanning between the central island and the outer wall section 14, the purpose of which will be described hereinafter. The channels 16, 17 and 18 are preferably closed in by plates as is the cavity 20; however; the plate covering cavity 20 has been omitted to show further features of the invention which will be described hereinafter. The plates 21 are configured to close in the open faces of the channels 16, 17 and 18 and cavity 20 and lie substantially flush with the upper surface of the base 13. The plate members include, for example, perforations 22 to allow the working fluid to pass into and circulate through the channels and cavity.

The reservoir including the channels is preferably formed from stainless steel.

The island 11 as shown in FIGS. 1 and 2 comprises a continuous cylindrical member preferably also formed from stainless steel and fixed by for example welding to the central portion of the base 13 so as to define a sealed annular channel 12. The upper end of the island 11, shown in FIG. 2, is closed by a plate 23 while the bottom end thereof is open to the space beneath the apparatus owing to a central aperture 24 in the base, however this is not important to the working of the invention and either end of the island 11 may be opened or closed as desired.

A further channel (not shown) or means of like effect may be provided at or adjacent the junction between the island and the base of the reservoir to communicate with channels 16, 17 or cavity 20.

The reservoir 10 preferably further includes a cover which may in part, as shown, comprise an extension of the wall 14 and in part a top plate **25*a* welded or otherwise affixed thereto. Over part of the extension of wall 14 a further part 25*b*** of the cover is preferably provided at 45° and this part 25*b* may, as shown, include a hatch **25*c* through which the machine may be loaded and unloaded. The hatch 25*c* or another part of the cover may include an inspection window (not shown). The cover and the hatch 25*c* are preferably all sealable so that operations may be carried on within the apparatus at a subatmospheric or super-atmospheric pressures. The top plate may further include a port 26** whereby steam can be lead from the interior of the apparatus.

As can be seen in FIG. 2 a first channel member 27*a* is provided extending across top plate 25*a* adjacent the edge of sloping portion 25*b*. A second channel member 27*b* is provided which extends along a diameter of the top plate perpendicular to channel 27*a* and meets and is fixed to the centre point of the channel member 27*a*. The channel members 27*a* and 27*b* add strength to the top plate 25*a* and further, the channel 27*b* serves as a mounting point for the paddle means in a manner as will be hereinafter described.

The paddle means is rotatably mounted above the reservoir on subframe 28 which is welded, bolted or otherwise fixed to the channel 27*b*, the paddle means preferably being adapted and arranged to pass, during rotation, over at least part of the plan area of the island. This assists in reducing the vertical height of the paddle means and thus assists in keeping the apparatus compact.

Figure 3:
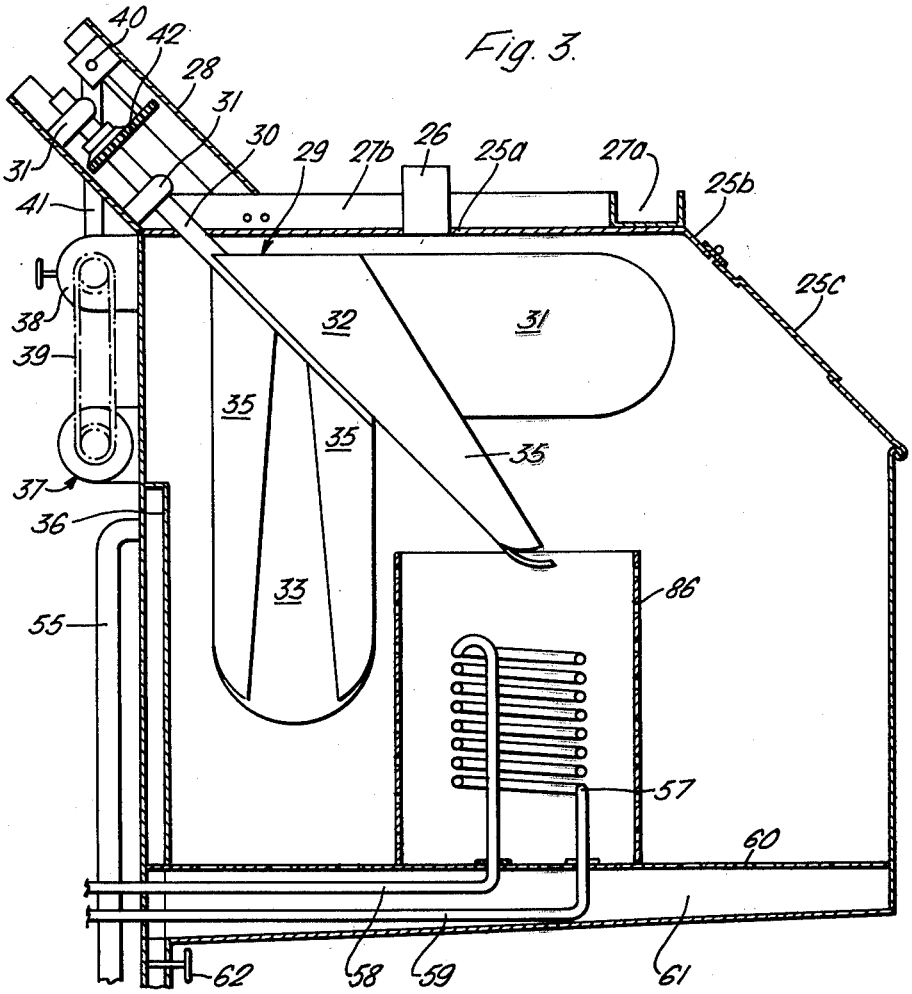
FIG. 3 depicts a cross-sectional elevational view of apparatus according to the invention showing the features omitted from FIGS. 1 and 2 and alternative features of the apparatus in other respects.

The preferred arrangement for effecting this is depicted in FIGS. 3 and 4 of the drawings in which the paddle means 29 comprises a plurality of paddle blades projecting from a shaft 30 which shaft when viewed in plan, lies along a radius of the reservoir but when viewed in elevation, as in FIGS. 3 and 4, lies substantially at 45° to the vertical. The shaft 30 is carried in bearing blocks 31 which in turn are mounted on the subframe 28.

The shaft 30 preferably carries four blade members equispaced therearound, the blade members being in the form of paddles projecting at substantially 45° from the axis of the shaft 30. In the drawings three of the paddle blades are depicted being indicated by the reference numerals 31, 32 and 33.

The paddle blades 31, 32, 33 and the unseen paddle blade are identical, paddle blade 33 being shown in cross section in FIG. 5. As shown each blade has an arcuate leading face 34 and two side plates 35, the side plates 35 curving rearwardly from the front surface 34 and inwardly of the outer edges thereof i.e. towards the central axis of the face 34. As can be more easily seen from FIGS. 3 and 4 with reference to paddle blades 32 and 33, the side plates 35 preferably taper down towards the tips of the paddle blades and as can be seen with reference to the blade 32 the tip of the front surface 34 of each blade is preferably turned back with respect to the direction of intended rotation of the paddle. We have found that this configuration provides a strong eddy or vortex effect behind the paddle blade as the paddle blade passes through the working fluid contained in the channel 12 and these vortices in turn ensure continuous circulation and movement of the garments or garment lengths undergoing treatment in the apparatus. Further the vortices created by the side plates 35 tend to draw the garments or garment lengths away from the surface of the island 11 and the walls 14 towards the centre of the channel 12 and thus reduce friction which in turn could lead to blockage.

The mounting of the paddle means is such that as any one of the paddle blades passes through the channel 12 it is substantially centrally disposed between the outer wall of the island 11 and a plate member 36 which when viewed in plan as in FIG. 1, defines a chord between points on the interior surface of the wall 14, which chord is centrally disposed about the axis of the shaft 30. The plate 36 is liberally perforated so that the working fluid may circulate there-behind.

Although the paddle means is depicted as being mounted with the shaft 30 at 45° to the horizontal when viewed in elevation as in FIG. 3, we have found that by slightly increasing the angle of the shaft 30 to the horizontal by, in the order of 1° or 2° the paddle blades have a greater tendency to draw garments away from the central island as they pass through the channel 12.

The paddle means is preferably driven from an electric motor 37 through a variable-speed gear box 38 by belt, chain or the like 39. The drive is then taken to a right angle drive reduction box 40 by a further belt, chain or like 41 and hence to the shaft 30 by a still further belt or chain 42. In the FIG. 4 embodiment drive is provided more simply by a variable speed motor 37*a* driving the shaft 30 through a chain or belt transmission 42*a*.

The operations of dyeing and milling and in some circumstances the operation of washing off finished garments and/or garment lengths require the addition of heat to the working fluid and for this purpose means are preferably included within the apparatus to raise the temperature of the working fluid in the channel 12. As shown in FIGS. 1 and 2 this means comprises a coil 43 mounted in cavity 20 in the base of the reservoir. The ends 43*a* of the coil 43 depicted may be coupled up to a steam generation and extraction plant (not shown) or alternatively coil 43 may be electric elements. It will be appreciated that the plate members such as that indicated by the reference numeral 21 cover the coil 43 and thus prevent garments or garment components coming into direct contact with the heating coils. The perforations 22 in the plates 21 however allow the ready circulation of the working fluid over the coils.

The degree of circulation of the working fluid provided by the paddling means may not be sufficient, in use, to mill the garments in a sufficiently short period of time and for this purpose supplementary agitation or circulation means is preferably provided. In the embodiment described in FIGS. 1 and 2 this supplementary agitation means comprises two pumps 44 which draw fluid from the reservoir and deliver the fluid back into the channel 12 at an increased velocity. The extra circulation provided by the pumps 44 also allows the rate of temperature rise to be increased in the dyeing operation.

The form of these pumps 44 is described more explicitly in our co-pending New Zealand Patent application No. 189925 however in the preferred embodiment as used herein, each pump 44 comprises a helical vane, (not shown) mounted for rotation on the shaft 45. The helical vane is provided with a fixed shroud 46 therearound which rotates with the vane and the shaft 45. The vane and shroud 46 are mounted in a pump chamber 47 and a seal 48 provided fixed to the inner wall of chamber 47 but forming a rotating, sliding seal on the external surface of the shroud 46. Thus rotation of the shaft 45 rotates the vane and shroud 46 and thus creates a differential pressure on either side of the seal 48. The shaft 45 is mounted in bearing blocks 45*a* which are mounted on the interior surface of the peripheral wall 14 behind the plate 36 and are either lubricated by the working fluid or alternatively are of a sealed type not exposed to or alternatively not detrimentally effected by the working fluid. Since the blocks 45*a* and the shaft 45 are enclosed within the segment defined by the plate 36, no garments or garment lengths within the channel 12 may become entangled therewith.

It will be seen from FIG. 1 that each of the pumps 44 is situated adjacent the cavity 20 and it will be further appreciated from FIG. 2 that the vanes and shrouds i.e. the operative parts of the pumps are situated below the base of the cavity 20. Thus the pumps advantageously serve as draining points for the apparatus and the bottom of each pump chamber may include a valve 49 which, on opening, allows the working liquid to pass therethrough.

The delivery side of each pump 44 is preferably connected to a manifold 50 in communication with the channel 12 by means of a delivery conduit 51. Each manifold 50 includes a branch 52 in the floor of the channel 12 and a branch 53 in a wall of the channel 12. As shown in FIG. 1 branch 52 spans along or parallel to a radius of the reservoir across the floor of the channel 12 between the outer wall 14 and the island 11 while branch 53 projects up a wall of the island from the inner end of the branch 52. The branches 52 and 53 of the manifold lie substantially below the planes of the base 12 and the wall of the island 11 respectively but protrude a small amount therefrom so that fluid may issue from the manifolds into the channel. The protruding parts bear apertures (not shown) which face in the direction of circulation created by the rotation of the paddle means. Upon activation of the pumps 44 the working fluid is drawn into the top of the shroud 46 and vane and delivered under pressure to the pipes 51, thence into the manifold branches 52 and 53. We have found that the added component of circulation provided by the pumps 43 provides a vigorous milling action and thus ensures that garments or garment lengths may be milled in a time deemed acceptable by those skilled in the art. Furthermore the increased circulation allows the rate of temperature rise during the dyeing operation to be increased.

Still further the position of the branches 52 assist in draining fluid from the apparatus at the end of an operation.

The pumps 44 are preferably driven by separate electric motors (not shown) which may be mounted outside the reservoir and drive the shafts 45 through belts or some other suitable form of transmission. The belts or other transmissions pass through apertures in the wall 14 above the working fluid level.

It will be appreciated by those skilled in the art that prolonged excessive circulation of the working fluid could result in the garment or garment lengths being over milled and for this reason the motors powering the pumps 44 are preferably provided with control mechanisms to shut off the pumps after a predetermined length of time. Such controls may, for example, comprise electric timers wired into the circuit of the electric motors powering the pumps so that at the end of a predetermined milling sequence the current to the motors is stopped. Alternatively the motors could be variable speed motors or drive the shaft 45 through variable speed gearing.

With reference to FIG. 1 the section line labelled II—II is the line along which the paddle means shaft 30 is mounted and it will be noted that the manifolds 50 distributing the supplementary circulation are substantially equi-spaced about this line. Thus the supplementary agitation is added to the main circulation created by the paddling means toward the start and finish of the main circulation phase.

For dyeing or even some milling purposes it may be necessary to have a reduced degree of supplementary agitation. This could be achieved by powering the pumps 44 with variable speed driving means but for economic reasons the reduced circulation can be achieved by stopping one of the pumps 44.

For the washing off operation using the apparatus described it is desirable to have the apparatus continually overflowing i.e. fresh water being added continuously. For this reason overflow pipe 55 is provided passing through the reservoir wall 14 into the segment defined by the plate 36 so that garments within the channel 12 cannot foul with and block off the overflow aperture. It will be appreciated that the overflow aperture defines the operative level of the working fluid.

The apparatus further includes means to add dyestuffs and/or other chemicals to the working fluid comprising a conduit 70 having a receiving end 71 positioned at a convenient point outside the reservoir 10, the conduit passing down the wall 14 to terminate in a delivery end 72 which is preferably situated just above or adjacent the top of the rotating element of one of the pumps 44.

FIGS. 3 and 4 while depicting the preferred paddling means for all the embodiments also disclose additional modifications to the central island and to the reservoir.

FIG. 3 depicts apparatus in which the central island 56 is not a continuous cylindrical member as was the island 11 in FIGS. 1 and 2 but is a perforated cylindrical dividing member thus allowing the working fluid to flow freely therethrough. With this configuration of island the base of the reservoir is necessarily continuous and the fluid heating means advantageously comprises a coil 57 disposed centrally within the island fed from and extracted by pipes 58 and 59 passing beneath the base of the reservoir. The pipes 58 and 59 pass through suitable sealing means in the base to communicate with the coil 57. As with the coil 43 previously described, the pipes 58 and 59 may be connected to suitable steam generation and extraction plant or alternatively the coil 57 may be electrically heated. As shown in FIG. 3, the base 60 of the reservoir includes at least one channel 61, the base of which slopes towards an outlet drain 62.

While no supplementary agitation means is depicted in the FIG. 3 embodiment this means may be the same as that depicted in and described with reference to FIGS. 1 and 2 and include a like form of manifolding, however only one pump may, if desired, be employed. In the FIG. 3 embodiment the dye/chemical adding facility may be as described above or alternatively the dye/chemical may be added manually into the centre of island 56 and drawn therefrom by the circulation of the working fluid.

The FIG. 4 embodiment discloses a similar form of supplementary agitation means as that already described, however this embodiment describes yet a further modification of the central island in which the island comprises a perforated outer cylindrical member 63 and an inner continuous cylindrical member 64. The working fluid being free to circulate in the space 65 between the two members. This space is preferably occupied, at least in part by the working fluid heating means which as shown, comprises a steam coil 66 wound around the outer surface of the continuous cylindrical member 64. The pipe 67 connecting to the lower end of the coil 66 may pass in a fluid tight manner through the floor 68 of the reservoir whereas the pipe 69 attaching to the upper end of the coil 66 may pass down through the centre of the inner continuous cylindrical member 64.

The dye/chemical adding facility is not depicted for this embodiment however it may conveniently be the same as that of the FIGS. 1 and 2 embodiment.

It will be appreciated that the island arrangement depicted in FIGS. 1 and 4 reduces the working fluid requirement by an amount equal to the swept volume of the island. If the apparatus is to be used for dyeing then obviously there will be a reduction in the dyestuff and liquor requirements but more importantly the volume of working fluid is reduced and accordingly the energy requirements for heating this fluid are reduced. Thus the FIGS. 1 and 4 embodiment has obvious economic savings.

The use of the invention is as follows:

Which ever operation is to be carried out the reservoir is preferably filled with the working fluid, which is commonly water, to a level just below the top of the island and the level of the overflow 55. The garments may then be inserted through the hatch 25*c* and the paddle means activated to circulate the garments within the channel.

If the operation to be performed is dyeing then depending on the nature of the dyestuff the heating means is activated by, in this instance, passing steam through the coils 43, 55 or 64. In the case of the FIGS. 1 and 2 embodiment the dyestuff is added through end 71 of the conduit 70, passes through conduit 70 and into one of the pump chambers 47. The appropriate pump 44 may then be actuated to displace the dyestuff out into the channel 12 through the manifold or manifolds 50.

A similar means may be employed to circulate the dyestuff in the FIG. 4 embodiment.

In the FIG. 3 embodiment the dyestuff may be added down into the centre of the island 56 from whence it will be drawn out into the channel 12 through the perforations in the island by the circulation created by the paddle means.

If the operation to be performed is milling then essentially the same initial steps are taken, i.e. the garments are placed in the reservoir and the paddle means activated to create circulation in the channel 12.

For the milling operation however the supplementary agitation means is activated for a pre-determined period of time to provide a much increased circulation of the working fluid within the channel 12. This increased circulation may, according to need and/or desire be accompanied by some application of heat through the heating means 43, 57, 66.

The washing off operation commonly involves just circulation of the garments by the paddle means with no supplementary circulation and commonly no heat, although in some circumstances a small degree of either of these may be desirable. Fresh water from a cold or warm water supply may be added continuously, the excess draining off through overflow 55 depicted in the FIGS. 1 and 2 embodiment but preferably included in all embodiments.

We have found that the circular channel provided in all embodiments of our apparatus in accordance with the invention is particularly advantageous and results in a smooth and even circulation of the working fluid, there being substantially no areas of zero circulation. The improved geometry of the reservoir thus allows the paddle speed to be reduced which in turn results in less wear and tear on the garments. We have further found that the preferred type of paddle blade incorporated in the apparatus above described provides a strong and effective vortex being formed behind the paddle blades and we have found that it is not uncommon for the garments to be tumbled by the circulation formed thereby over at least half the channel length even though the paddle blades are only in the channel for a very small portion of the length thereof.

I claim:

1. A dyeing, washing and/or milling apparatus including a substantially circular working fluid reservoir; an island disposed centrally within said reservoir so as to define an annular channel within said reservoir; a plurality of paddle members mounted above said reservoir for uni-directional rotation about a fixed axis so that during rotation thereof said paddle members are displaced into and out of said channel to circulate working fluid therein around said channel; and supplementary circulation means to increase the circulation of a working fluid within said reservoir over the circulation produced by said paddle means.

2. A dyeing, washing and/or milling apparatus including a substantially circular working fluid reservoir; an island disposed centrally within said reservoir so as to define an annular channel within said reservoir; a plurality of paddle members mounted above said reservoir for uni-directional rotation about a fixed axis so that during rotation thereof said paddle members are displaced into and out of said channel and, while in said channel, have a component of movement tangential to a circumferential line around said channel; the leading face of each of said paddle members being arcuate in cross-section to define edges which lie rearward of the center of the arcuate face.

3. Apparatus as claimed in claim 1 or claim 2 wherein said island comprises a liquid impervious cylindrical member mounted centrally within said reservoir.

4. Apparatus as claimed in claim 1 or claim 2 wherein said island comprises a perforated cylindrical member mounted centrally within said reservoir.

5. Apparatus as claimed in claim 4 wherein a heating coil is provided within said perforated cylindrical member adapted to heat said working fluid in use.

6. Apparatus as claimed in claim 1 or claim 2 wherein said reservoir has a substantially flat base.

7. Apparatus as claimed in claim 6 wherein said base includes at least one channel therein below the general plane thereof.

8. Apparatus as claimed in claim 7 further including at least one heating coil located in said channel which, in use, communicates with working fluid within said channel.

9. Apparatus as claimed in claim 8 further including perforated plate members covering said channel, said plate members lying substantially in the plane of said base.

10. Apparatus as claimed in claim 2 wherein said paddle members are configurated and mounted to pass over at least a portion of said island during the rotation thereof.

11. Apparatus as claimed in claim 10 wherein each of said paddle members project from a common shaft, said shaft being mounted substantially along a radius of said reservoir when viewed in plan but angled to the vertical when viewed in elevation.

12. Apparatus as claimed in claim 11 wherein said shaft is angled at substantially 45° to the vertical when viewed in elevation.

13. Apparatus as claimed in claim 12 wherein said blade members project from said shaft at substantially 45° to the axis thereof.

14. Apparatus as claimed in any one of claims 11 to 13 wherein said paddle members comprise four paddle blades substantially equally spaced about said shaft.

15. Apparatus as claimed in claim 14 wherein a side plate projects rearward from each edge of said arcuate leading face.

16. Apparatus as claimed in claim 15 wherein said side plates are further curved in toward an axis through the center of said arcuate face.

17. Apparatus as claimed in claim 1 wherein said supplementary circulation means includes a pump to circulate the working fluid within said reservoir.

18. Apparatus as claimed in claim 17 further including a manifold in communication with the outlet of said pump, said manifold being configured to direct fluid delivered by said pump into said channel.

19. Apparatus as claimed in claim 18 wherein said manifold includes a branch spanning along the floor of said channel and a branch spanning up a wall of said channel.

20. Apparatus as claimed in claim 19 wherein the branch spanning along the floor of said reservoir is arranged substantially along or parallel to a radius of said reservoir.

21. Apparatus as claimed in claim 19 or claim 20 wherein the branch spanning up a wall of said channel is attached to or forms part of the wall of said island.

22. Apparatus as claimed in any one of claims 17 to 20 further including a control mechanism to control the period of operation of said pump.

23. Apparatus as claimed in claims 1 or 2 further including a cover enclosing the upper surface of said reservoir.

24. Apparatus as claimed in claim 23 wherein said cover is sealable to said reservoir so that the interior of said reservoir may be subject to super atmospheric or sub-atmospheric pressures.

* * * * *